US005636617A

United States Patent [19]

Nakatsu

[11] Patent Number: 5,636,617

[45] Date of Patent: Jun. 10, 1997

[54] ENGINE FUEL VAPOR PROCESSOR

[75] Inventor: Shuichi Nakatsu, Kanagawa, Japan

[73] Assignee: Nissan Motor Co., Ltd., Kanagawa, Japan

[21] Appl. No.: 501,229

[22] Filed: Jul. 11, 1995

[30] Foreign Application Priority Data

Jul. 11, 1994 [JP] Japan ..... 6-158652

[51] Int. Cl.[6] ..... F02M 33/02

[52] U.S. Cl. ..... 123/519; 123/516

[58] Field of Search ..... 123/516, 518, 123/519, 520, 521, 198 D, 198 DB, 458

[56] References Cited

U.S. PATENT DOCUMENTS

| | | | |
|---|---|---|---|
| 3,491,736 | 1/1970 | Walker | 123/521 |
| 4,809,667 | 3/1989 | Vranishi | 123/520 |
| 5,113,824 | 5/1992 | Aramaki | 123/520 |
| 5,191,870 | 3/1993 | Cook | 123/520 |
| 5,469,832 | 11/1995 | Nemoto | 123/520 |
| 5,474,049 | 12/1995 | Nagaishi | 123/520 |

FOREIGN PATENT DOCUMENTS

| | | | |
|---|---|---|---|
| 0018158 | 1/1988 | Japan | 123/519 |
| 5-69987 | 3/1993 | Japan . | |

*Primary Examiner*—Carl S. Miller

*Attorney, Agent, or Firm*—Lowe, Price, LeBlanc & Becker

[57] ABSTRACT

Fuel vapor in a fuel tank of a vehicle is adsorbed in a canister, released from the canister under negative intake pressure while a vehicle is being driven, and supplied to an engine intake passage. A valve is provided in a purge passage extending from the canister to the intake passage. Liquefied fuel is prevented from accumulating in the valve and purge passage by situating this valve at a higher position than a first connecting part connecting the canister with the purge passage, and a second connecting part connecting the purge passage with the intake passage. In this way, faulty operation of the valve due to the accumulated fuel turning to gum is prevented, richness of the air-fuel ratio due to accumulated fuel when purge starts is prevented, and impairment of engine drivability and exhaust gas composition are prevented.

6 Claims, 5 Drawing Sheets

ENGINE FUEL VAPOR PROCESSOR

FIELD OF THE INVENTION

This invention relates to a processor for processing fuel evaporated from a fuel tank of an automobile engine.

BACKGROUND OF THE INVENTION

A fuel vapor processor that prevents fuel in an automobile engine fuel tank from escaping into the atmosphere is described for example in Tokko Hei 5-69987 published by the Japanese Patent Office in 1993.

In this processor, fuel vapor in the engine tank is adsorbed on active carbon in a canister when the engine has stopped, and the canister is brought into contact with an engine intake passage under predetermined engine running conditions via a purge passage where a purge cut valve and a purge control valve are installed. When the engine is running, the intake passage is at a negative pressure. Fuel vapor released from the active carbon in the canister by means of this negative pressure and atmospheric air introduced in the canister is supplied to the intake passage, and is then burnt in the engine.

In this type of fuel vapor processor, fuel vapor tends to liquefy in the purge passage, and to build up in the purge cut valve or purge control valve. This liquefied fuel may turn to a sticky gum that adheres to the valve seat of the valves so that the valves may no longer function properly.

SUMMARY OF THE INVENTION

It is therefore an object of this invention to prevent fuel that has liquefied in the purge passage from a accumulating in a purge cut valve or purge control valve.

It is a further object of this invention to prevent fuel that has collected in the purge passage from causing a rich air-fuel ratio when purging is started and impairing the engine drivability or exhaust composition.

In order to achieve the above objects, this invention provides an engine fuel vapor processor for supplying fuel that has vaporized from a fuel tank to an engine intake passage according to an engine running condition. The processor comprises a canister for adsorbing fuel vapor in the fuel tank, a purge passage for connecting the canister and the intake passage, a first connecting part for connecting the purge passage to the canister, a second connecting part for connecting the purge passage to the intake passage, and valve mechanism installed in the purge passage. This valve mechanism is disposed at a higher position than the first and second connecting parts.

It is preferable that the valve mechanism comprises a purge control valve for regulating a flow area of the purge passage according to the engine running condition, and a purge cut valve for shutting the purge passage disposed in series with the purge control valve at effectively the same height.

In this case, the purge control valve may be disposed nearer to the intake passage than the purge cut valve, or purge cut valve may be disposed nearer to the intake passage than the purge control valve.

Preferably, the purge control valve comprises a valve body driven by a step motor, and the purge cut valve comprises a valve body attached to a diaphragm, a negative pressure passage for introducing a negative pressure in the intake pressure to the diaphragm so as to lift the valve body, and a solenoid valve for opening and closing the negative pressure passage.

The valve mechanism may comprise two connecting tubes that project horizontally, and the purge passage comprises a pipe connecting one of the tubes with the first connecting part and a pipe connecting the other of the tubes with the second connecting part.

This invention also provides an engine fuel vapor processor comprising a canister for adsorbing fuel vapor in the fuel tank, a purge passage for connecting the canister and the intake passage, a first connecting part for connecting the purge passage to the canister, a second connecting part for connecting the purge passage to the intake passage, a purge cut valve for shutting the purge passage, this purge cut valve being disposed at a higher position than the first connecting part, a purge control valve for adjusting a flow area of the purge passage according to the engine running condition, this purge control valve being disposed between the purge cut valve and the second connecting part at a higher position than the second connecting part and lower than the purge cut valve, and a mechanism for closing the purge cut valve before closing the purge control valve.

In this case, it is preferable that the purge control valve comprises a valve body driven by a step motor and that the purge cut valve comprises a valve body attached to a diaphragm, a negative pressure passage for introducing a negative pressure in the intake passage to the diaphragm so as to lift the valve body, and a solenoid valve for opening and closing the negative pressure passage.

This invention also provides an engine fuel vapor processor comprising a canister for adsorbing fuel vapor in the fuel tank, a purge passage for connecting the canister and the intake passage, a first connecting part for connecting the purge passage to the canister, a second connecting part for connecting the purge passage to the intake passage, a purge cut valve for shutting the purge passage, this purge cut valve being disposed at a higher position than the first connecting part, a purge control valve for adjusting a flow area of the purge passage according to the engine running condition. The purge control valve is disposed between the purge cut valve and the second connecting part at a higher position than the second connecting part and higher than the purge cut valve, and a mechanism for closing the purge control valve before closing the purge cut valve.

In this case, it is preferable that the purge control valve comprises a valve body driven by a step motor and the purge cut valve comprises a valve body attached to a diaphragm, a negative pressure passage for introducing a negative pressure in the intake passage to the diaphragm so as to lift the valve body, and a solenoid valve for opening and closing the negative pressure passage.

The details as well as other features and advantages of this invention are set forth in the remainder of the specification and are shown in the accompanying drawings.

DESCRIPTION OF THE PREFERRED EMBODIMENTS

Figure 7:
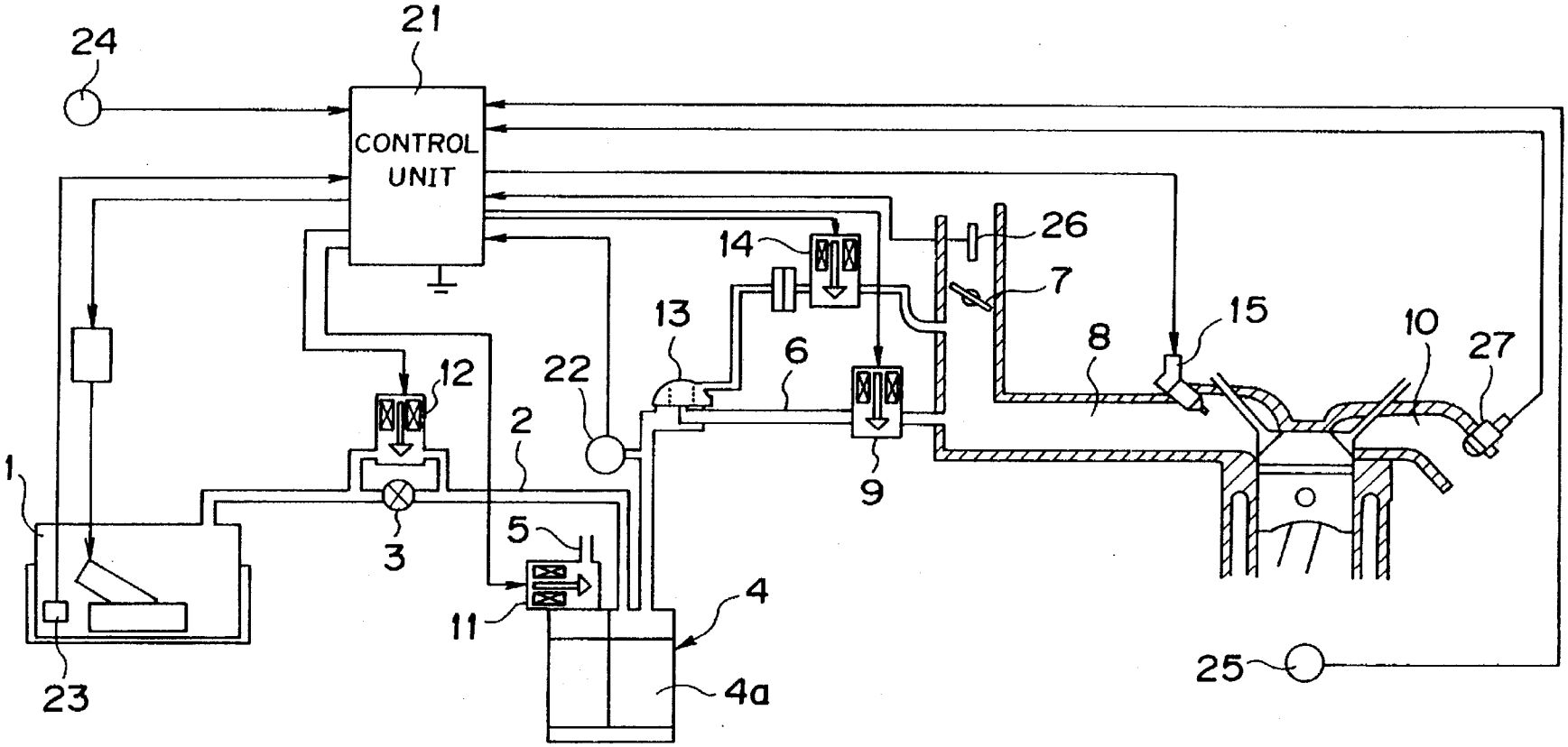
FIG. 7 is a schematic diagram of a fuel vapor processor control system according to this invention.

Referring to FIG. 7 of the drawings, an air intake throttle 7 and an injector 15 for injecting fuel are provided in an engine intake passage 8, and a control unit 21 comprising a microprocessor is provided for controlling the fuel injection mount. The fuel injected by the injector 15 is provided from a fuel tank 1.

An engine air intake volume detected by an air flow meter 26, a Ref signal output every reference crank angle by a rotation sensor 25 and an engine cooling water temperature detected by a cooling water temperature sensor 24 are input to the control unit 21, and the control unit 21 computes a basic fuel injection mount based on these input signals.

An $O_2$ sensor 27 for detecting oxygen concentration in the exhaust is further provided midway in an exhaust passage 10. From the output of the $O_2$ sensor according to the detected oxygen concentration in the exhaust, the control unit 21 feedback controls the fuel injection mount so that the air-fuel mixture provided to the engine has the theoretical air-fuel ratio. The efficiency of a three-way catalyst converter, not shown, installed in the exhaust passage 10, is thereby maintained at a maximum efficiency.

A fuel vapor processor is provided with a canister 4. Fuel that has vaporized from the tank 1 is led to the canister 4 via a charge passage 2, and is adsorbed by active carbon 4*a* in the canister 4. A check valve 3 is interposed in the charge passage 2. The canister 4 is provided with a drain cut valve 11 which is normally open for supplying fresh air to the canister 4.

The canister 4 is connected to the intake passage 8 downstream of the intake throttle 7 via a purge passage 6. A purge control valve 9 and a purge cut valve 13 are installed in series in the purge passage 6. The purge control valve 9 is normally closed, and is driven by a step motor for opening to a degree specified by the control unit 21.

Figure 5:
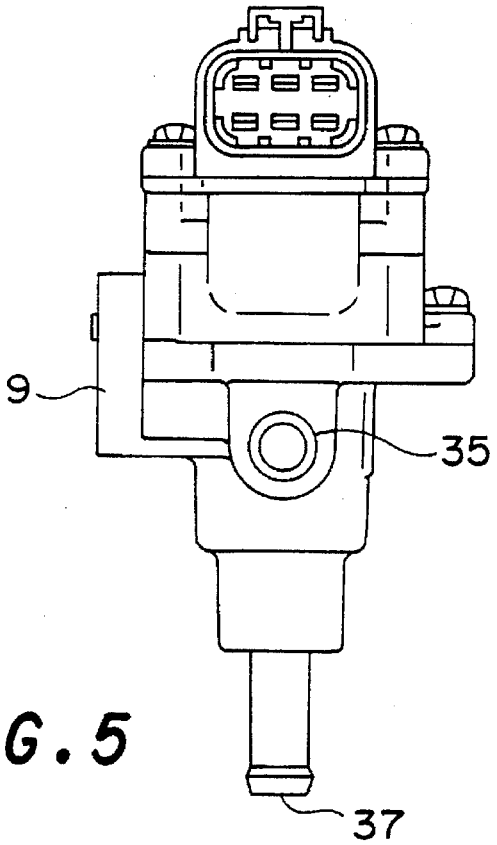
FIG. 5 is a side view of a purge control valve according to this invention.
Figure 6:
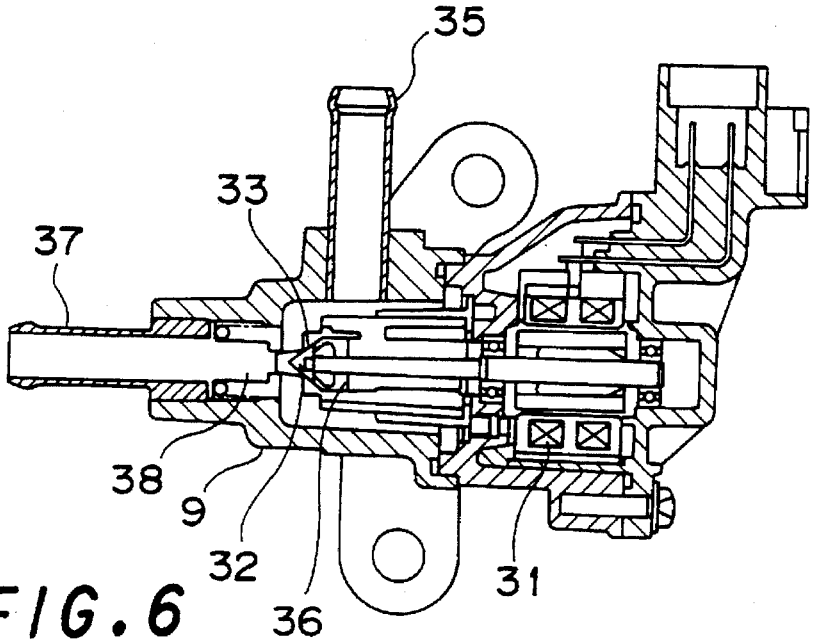
FIG. 6 is a vertical sectional view of the purge control valve.

As shown in FIGS. 5 and 6, the purge control valve 9 is provided with a valve body 32 that is displaced in an axial direction by a step motor 31. The valve body 32 fits on a valve seat 33 so as to shut the passage 6, and when it leaves the seat 33, the opening surface area of the passage 6 is increased so as to regulate the amount of purge gas supplied to the intake passage 8.

Figure 3:
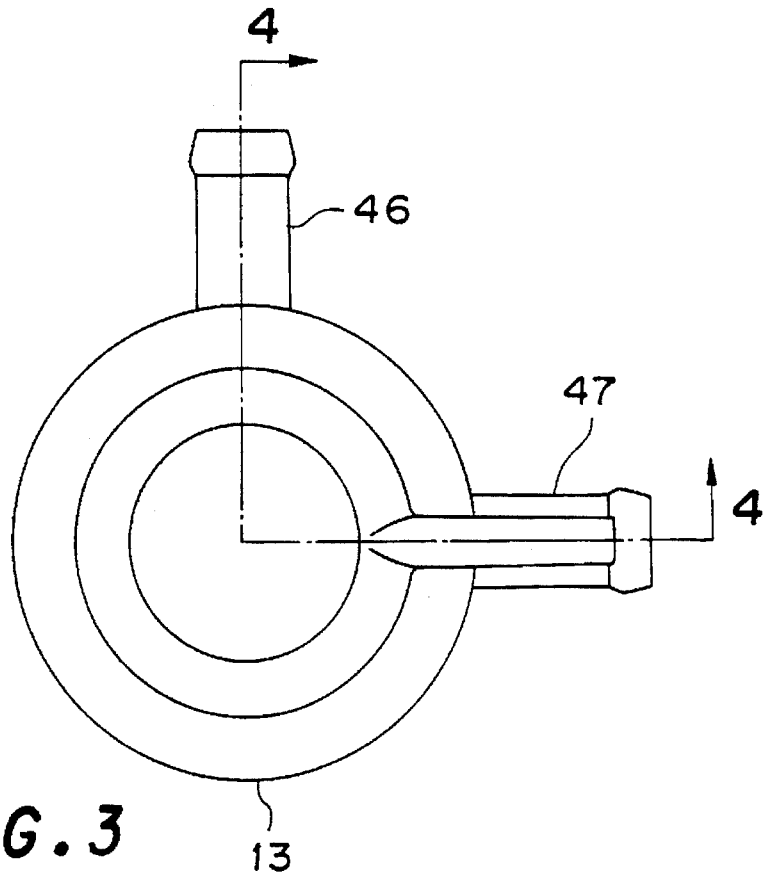
FIG. 3 is a plan view of a purge cut valve according to this invention.
Figure 4:
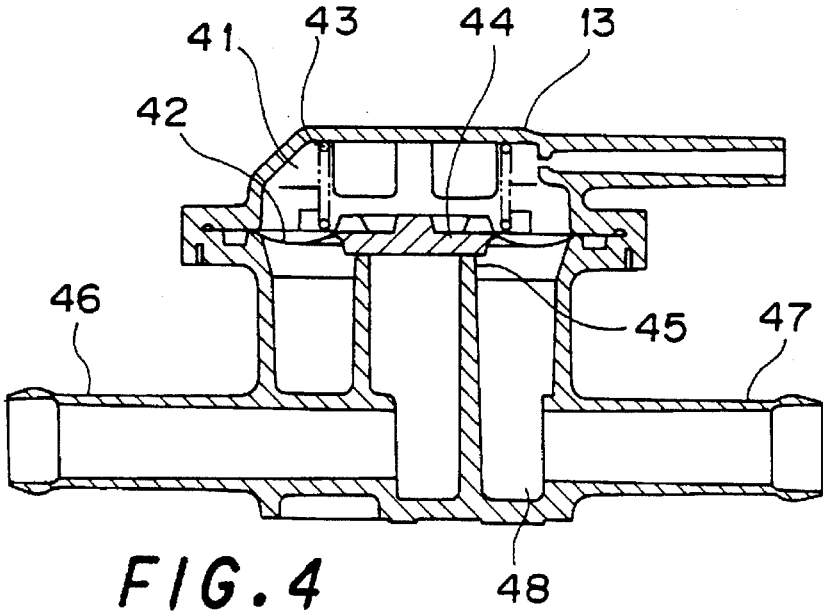
FIG. 4 is a vertical sectional view of the purge cut valve taken along a line 4—4 in FIG. 3.

As shown in FIGS. 3 and 4, the purge cut valve 13 is provided with a diaphragm 42 forming a negative pressure chamber 41, a valve body 44 being attached to the diaphragm 42. The valve body 44 fits into a vertical valve seat 45 having a cylindrical shape so as to shut the purge passage 6, and when it leaves the seat 45, the purge passage 6 is opened.

When the engine conditions are suitable for purging of adsorbed fuel from the canister 4, the control unit 21 opens the purge control valve 9 and a solenoid valve 14, and negative pressure generated in the intake passage 8 downstream of the throttle 7 is introduced into the negative pressure working chamber 41 of the purge cut valve 13. Due to this negative pressure, the diaphragm 42 is pulled upwards against the force of a return spring 43 as shown in FIG. 4 so as to open the purge passage 6. Under other conditions, the purge passage 6 is shut by the purge cut valve 13 which is normally closed, and entry of purge gas into the intake passage 8 is prevented.

When the solenoid valve 14 opens due to a signal from the control unit 21, fresh air is led from a fresh air entry passage 5 into the canister 4 via the drain cut valve 11 due to intake negative pressure generated downstream of the throttle 7. As FIG. 7 is a schematic diagram, the fresh air passage 5 and drain cut valve 11 are drawn above the canister 4, but in practice they are located below the canister 4.

Due to the fresh air introduced into the canister 4, fuel adhering to the active carbon 4*a* is released from the carbon 4*a*, enters the intake passage 8 as fuel vapor together with fresh air, and is burnt in a combustion chamber of the engine.

However, if fuel that has accumulated inside the purge cut valve 13 and purge control valve 9 turns to a sticky gum, the valve bodies 32, 44 may stick respectively to the valve seats 33, 45 so that they Jam and the valves no longer function.

Figure 1:
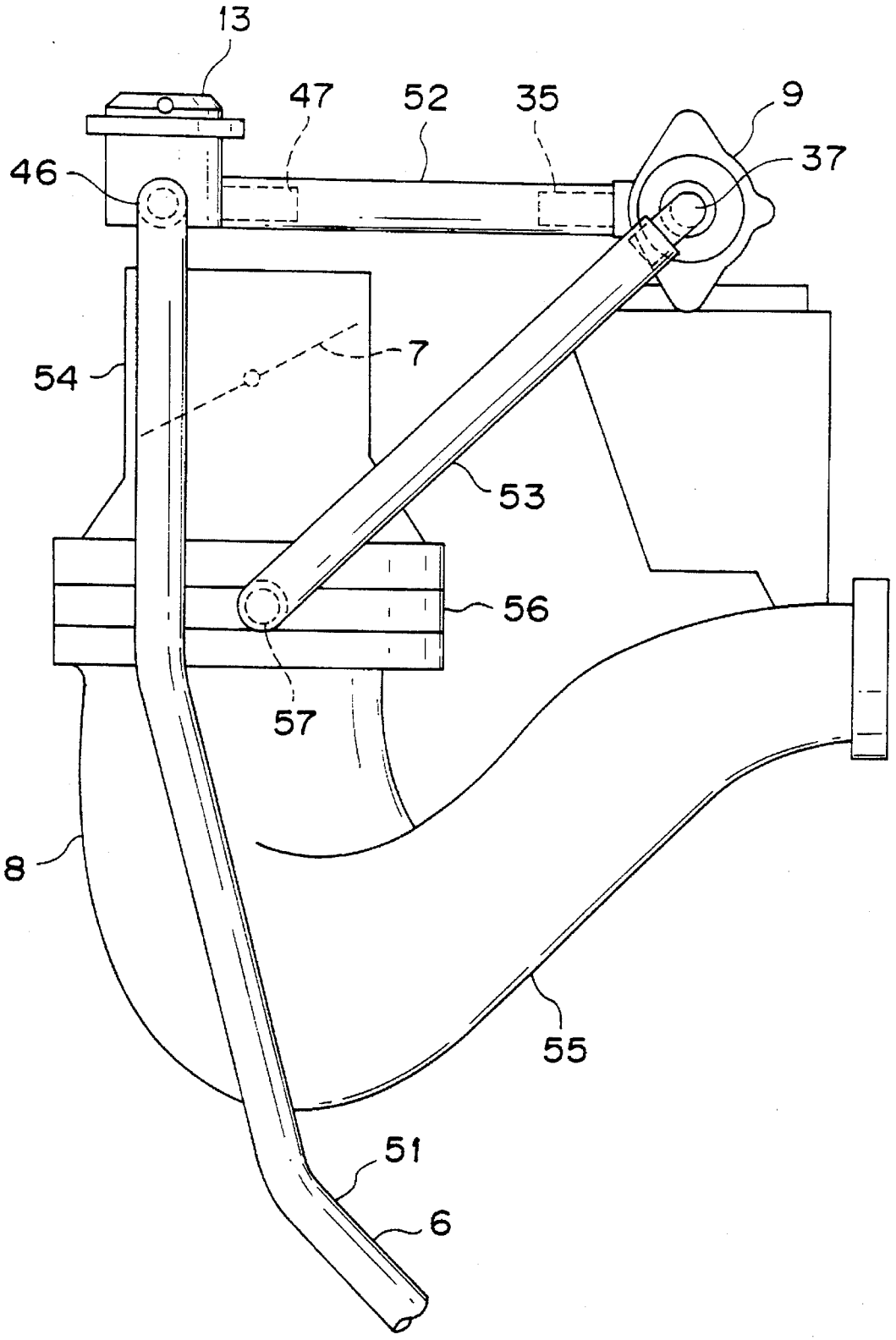
FIG. 1 is a side view of a fuel vapor controller according to this invention.
Figure 2:
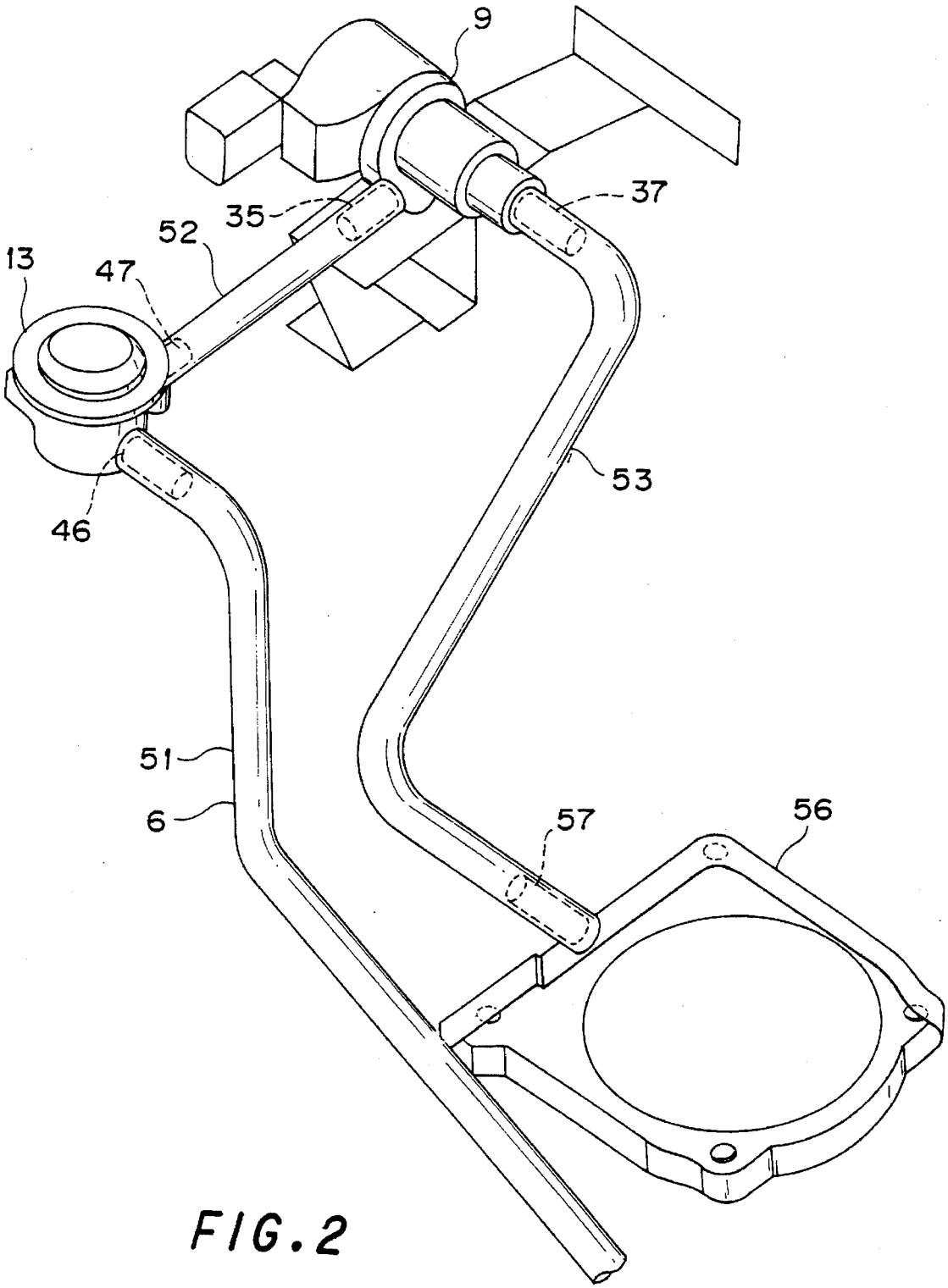
FIG. 2 is a perspective view of the fuel vapor controller.

The purge cut valve 13 and purge control valve 9 are therefore situated in higher positions than the connecting part between the purge passage 6 and the canister 4, and the connecting part between the purge passage 6 and intake passage 8, as shown in FIGS. 1 and 2. The heights of the purge cut valve 13 and purge control valve 9 are set to be identical.

The upper end of a pipe 51 connecting the canister 4 and purge cut valve 13 is connected to a connector tube 46 of the purge cut valve 13, and its lower end is connected to the canister 4 situated below.

The connector tube 46 is attached horizontally to the purge cut valve 13, and opens onto the lower end of the cylindrical seat 45 of the purge cut valve 13 as shown in FIG. 4.

A pipe 52 is installed horizontally linking the purge cut valve 13 and purge control valve 9, one of its ends being connected to a horizontal connector tube 47 of the purge cut valve 13 and the other end being connected to a horizontal connector tube 35 of the purge control valve 9.

The purge cut valve 13 comprises a chamber 48 in the form of a cylindrical envelope around the seat 45, the lower end of the chamber 48 being connected to the connecting tube 47. When the valve body 44 lifts, the connector tube 46 linked to the inside of the envelope and the connector tube 47 connected to the chamber 48, are connected together.

The connector tube 35 is linked to a chamber 36 upstream of the join between the valve body 32 and valve seat 33 of the purge control valve 9. The purge control valve 9 is provided with a connector tube 37 connected to a chamber 38 downstream of the join of the valve body 32 and valve seat 33. The connectors 35, 37 are respectively fixed horizontally to the purge control valve 9 at the same height. The upper end of a pipe 53 joining the purge control valve 9 and air intake valve 8 is connected to the connector tube 37 of the purge control valve 9, this pipe 53 extending downwards toward the air intake pipe 8 from the connector tube 37.

As shown in FIG. 1, the lower end of the pipe 53 is connected between a throttle chamber 54 and intake manifold 55 forming the intake passage 8 via an adaptor 56. The adaptor 56 is provided with a connector tube 57 so as to connect to the pipe 53. This connector tube 57 is connected to the intake manifold 55 upstream of a branch tube connected to each cylinder.

In this fuel vapor processor, as the purge cut valve 13 and purge control valve 9 are disposed at higher positions than the connections of the purge passage 6 with the canister 4 and intake passage 8, fuel that has liquefied in the pipe 51 returns to the canister 4, and fuel that has liquefied in the pipe 53 flows into the intake passage 8.

Further, as the purge cut valve 13 and purge control valve 9 are disposed at the same height, fuel that has liquefied in the horizontal pipe 52 linking the two, flows into the air intake pipe 8 via the pipe 53 from the purge control valve 9 due to the intake negative pressure region when the purge control valve 9 is opened.

As liquid fuel does not therefore accumulate in the purge cut valve 13 or purge control valve 9, liquid fuel does not turn into a sticky gum, hence there is very little risk that the valve bodies 32, 44 stick to the valve seats 33, 45, and the valves 13 and 9 maintain satisfactory operating performance over a long period.

Further, as liquid fuel does not accumulate in the purge passage 6 or the intermediate purge cut valve 13 or purge control valve 9, this accumulated fuel does not suddenly flow into the air intake pipe 8 during purge so that the air-fuel mixture in the combustion chamber temporarily becomes richer. Impairment of drivability and exhaust gas composition due to a sharp increase in richness of the air-fuel mixture is therefore prevented.

The purge control valve 9 may also be disposed nearer the canister 4 than the purge cut valve 13, i.e. upstream. In this case, the purge control valve 9 must be disposed at a higher position than the connection of the purge passage 6 to the canister 4, and the purge cut valve 13 must be disposed at a higher position than the connection of the purge passage 6 to the intake passage 8.

Next, a second embodiment of this invention will be described.

According to this embodiment, the purge cut valve 13 is situated higher than the purge control valve 9.

The pipe 52 connecting the purge cut valve 13 and purge control valve 9 is therefore inclined downwards toward the purge control valve 9 from the purge cut valve 13.

When the purge passage 6 is to be shut depending on the engine running conditions, the control unit 21 first closes the purge cut valve 13, and then closes the purge control valve 9 after a predetermined time has elapsed from when the purge cut valve 13 was shut.

In this case, as the pipe 52 is inclined downward to the valve 9 from the valve 13, liquefied fuel in the pipe flows into the air intake pipe 8 from the valve 9 via the pipe 53 from when the valve 13 is shut until the valve 9 is shut.

Also according to this embodiment, therefore, liquid fuel does not accumulate in the purge cut valve 13 and purge control valve 9, and jamming of the valve bodies 32, 44 in the valve seats 33, 45 due to the liquid fuel turning into a gum, is thereby prevented. As in the preceding embodiment, the air-fuel mixture is prevented from temporarily becoming richer due to liquefied fuel flowing into the purge passage 6, purge cut valve 13 and purge control valve 9.

Next, a third embodiment will be described.

Here, the purge control valve 9 is disposed at a higher position than the purge cut valve 13. The pipe 52 connecting the valve 13 and valve 9 therefore inclines downwards towards the valve 13 from the valve 9.

When the purge passage 6 is to be shut according to the engine running conditions, the control unit 21 first closes the purge control valve 9, and then shuts the purge cut valve 13 at a predetermined time after the valve 9 is shut.

As the pipe 52 is inclined downwards toward the purge cut valve 13 from the purge control valve 9, liquefied fuel in the pipe 52 returns to the canister 4 from when the purge control valve 9 closes until the purge cut valve 13 closes.

Also according to this embodiment, sticking of the purge cut valve 13 and purge control valve 9 are prevented, and impairment of drivability and exhaust gas composition due to a richer air-fuel ratio at the beginning of purge are prevented.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. An engine fuel vapor processor for supplying fuel that has vaporized from a fuel tank to an engine intake passage according to an engine running condition, said processor comprising:

a canister for adsorbing fuel vapor in said fuel tank, a purge passage for connecting said canister and said intake passage, a first connecting part for connecting said purge passage to said canister, a second connecting part for connecting said purge passage to said intake passage, a purge cut valve for shutting said purge passage, said purge cut valve being disposed at a higher position than said first connecting part, a purge control valve for adjusting a flow area of said purge passage according to the engine running condition, said purge control valve being disposed between said purge cut valve and said second connecting part at a higher position than said second connecting part and lower than said purge cut valve, and means for closing said purge cut valve before closing said purge control valve.

2. A fuel vapor processor as defined in claim 1, wherein said purge control valve comprises a valve body driven by a step motor and said purge cut valve comprises a valve body attached to a diaphragm, a negative pressure passage for introducing a negative pressure in said intake passage to said diaphragm so as to lift said valve body, and a solenoid valve for opening and closing said negative pressure passage.

3. An engine fuel vapor processor for supplying fuel that has vaporized from a fuel tank to an engine intake passage according to an engine running condition, said processor comprising:

a canister for adsorbing fuel vapor in said fuel tank, a purge passage for connecting said canister and said intake passage, a first connecting part for connecting said purge passage to said canister, a second connecting part for connecting said purge passage to said intake passage, a purge cut valve for shutting said purge passage, said purge cut valve being disposed at a higher position than said first connecting part, a purge control valve for adjusting a flow area of said purge passage according to the engine running condition, said purge control valve being disposed between said purge cut valve and said second connecting part at a higher position than said second connecting part and higher than said purge cut valve, and means for closing said purge control valve before closing said purge cut valve.

4. A fuel vapor processor as defined in claim 3, wherein said purge control valve comprises a valve driven by a step motor and said purge cut valve comprises a valve body attached to a diaphragm, a negative pressure passage for introducing a negative pressure in said intake passage to said diaphragm so as to lift said valve body, and a solenoid valve for opening and closing said negative pressure passage.

5. A fuel vapor processor as defined in claim 1, wherein each of said valves comprises a connecting tube that projects horizontally, and said purge passage comprises a pipe connecting said tube of said purge cut valve with said first connecting part and a pipe connecting said tube of said purge control valve with said second connecting part.

6. A fuel vapor processor as defined in claim 3, wherein each of said valves comprises a connecting tube that projects horizontally, an said purge passage comprises a pipe connecting said tube of said purge cut valve with said first connecting part and a pipe connecting said tube of said purge control valve with said second connecting part.

* * * * *